US011040393B2

(12) United States Patent
Boecking et al.

(10) Patent No.: US 11,040,393 B2
(45) Date of Patent: Jun. 22, 2021

(54) TRANSPORT DEVICE

(71) Applicant: SMS Group GmbH, Duesseldorf (DE)

(72) Inventors: Sebastian Boecking, Siegen (DE); Guido Fick, Kreuztal (DE)

(73) Assignee: SMS GROUP GMBH, Duesseldorf (DE)

( * ) Notice: Subject to any disclaimer, the term of this patent is extended or adjusted under 35 U.S.C. 154(b) by 179 days.

(21) Appl. No.: 16/464,385

(22) PCT Filed: Nov. 24, 2017

(86) PCT No.: PCT/EP2017/080378
§ 371 (c)(1),
(2) Date: May 28, 2019

(87) PCT Pub. No.: WO2018/099823
PCT Pub. Date: Jun. 7, 2018

(65) Prior Publication Data

US 2021/0114087 A1 Apr. 22, 2021

(30) Foreign Application Priority Data

Nov. 29, 2016 (DE) ..... 10 2016 223 717.9

(51) Int. Cl.
*B22D 11/06* (2006.01)

(52) U.S. Cl.
CPC ..... *B22D 11/0657* (2013.01); *B22D 11/0608* (2013.01); *B22D 11/0688* (2013.01)

(58) Field of Classification Search
CPC ..... B22D 11/0608; B22D 11/0657; B22D 11/0688
See application file for complete search history.

(56) References Cited

U.S. PATENT DOCUMENTS 3,605,868 A * 9/1971 Giadorou ..... B22D 11/06 164/430
5,645,159 A * 7/1997 Luginbuhl ..... B22D 11/0657 198/838

* cited by examiner

*Primary Examiner* — Kevin E Yoon
(74) *Attorney, Agent, or Firm* — Abelman, Frayne & Schwab

(57) ABSTRACT

The invention relates to a transport device (10), in particular for transporting cooling blocks (12) in a caterpillar casting machine, comprising a guide rail (16), which forms an endless circulating track (U) for a caterpillar casting machine (14), and a support element (18) having a plurality of rollers (20), by means of which the support element (18) is guided on the guide rail (16) and rolls along same, wherein a cooling block (12) of a caterpillar casting machine (14) can be placed on the support element (18). The guide rail (16) has a first running surface (16.1) and a second running surface (16.2), wherein the running surfaces (16.1, 16.2) are provided on opposite sides of the guide rail (16). The support element (18) has at least three rollers (20.1, 20.2, 20.3), of which two rollers (20.1, 20.2) are in rolling contact with the first running surface (16.1) of the guide rail (16), and at least one further roller (20.3) is in rolling contact with the second running surface (16.2) of the guide rail (16), wherein at least one roller (20.1; 20.2; 20.3) is preloaded towards the guide rail (16).

10 Claims, 8 Drawing Sheets

TRANSPORT DEVICE

RELATED APPLICATIONS

This application is a National Phase application of International application PCT/EP2017/080378 filed Nov. 24, 2017 and claiming priority of German applications DE 10 2016 223 717.9 filed Nov. 29, 2016, both applications are incorporated herein by reference thereto.

The invention relates to a transport device, particularly for transporting cooling blocks in a caterpillar casting machine.

According to the prior art, particularly for the production of aluminum alloys, horizontal block casting machines are known, which function as a type of circulating caterpillar casting machine. Such a casting machine is known, for example, from EP 1 704 005 B1. In this case, the cooling elements of the casting machine form the wall of a moving casting mold on the straight sections and/or strands of casting caterpillars, which are arranged opposite one another. The casting caterpillars each consist of a plurality of cooling blocks endlessly connected to one another, which are transported along the circulating tracks of the caterpillar. For this purpose, the blocks consisting of block elements, which are spring-mounted on frames, are placed on chains. In doing so, the frames with the blocks are maintained there on the chains, where otherwise they would fall due to the force of gravity, by means of stationary magnets. The chain links are provided with rollers at their connection points, which roll off onto guide tracks. The casting machine according to EP 1 704 005 B1 has the disadvantage that significant friction losses are caused, particularly by the chain joints under load due to the caterpillar drive.

A further block casting machine, with which a moving mold is formed between circulating caterpillars, which are arranged opposite one another, is known from WO 95/26842. In this case, the dies and/or cooling blocks are each attached to support elements, which is illustrated in the side view of FIG. 11 for two adjacent support elements, which are guided along a guide rail with rollers. One of these support elements with a die attached thereto is shown again in the side view of FIG. 12. For such a support element according to WO 95/26842, there is a disadvantage in that it tends to tip over. This is indicated in FIG. 12 by the arrow K. Like dominoes which are in a row shortly before falling over, slanted surfaces with edges, at which height differences can form, thus form on the upper side of the adjacent cooling blocks with the block casting machine according to WO 95/26842. Such height differences disadvantageously result in marks on a surface of the casting material, which leads to losses in quality.

Accordingly, the object of the invention is to further develop a transport device, particularly for the transport of cooling blocks in a caterpillar casting machine, to the extent that the guidance of the cooling blocks is stabilized along a circulating track and thus the surface quality of the casting material is improved.

The above object is achieved by means of a transport device having the features indicated in claim 1 and further by a transport device having the features indicated in claim 5. Advantageous further embodiments of the invention are defined in the dependent claims.

A transport device according to the invention is used, in particular, for the transport of cooling blocks in a caterpillar or block casting machine, and comprises a guide rail, which forms an endless circulating track for a caterpillar casting machine, and a support element with a plurality of rollers, by means of which the support element is guided on the guide rail and rolls along same. A cooling block of a caterpillar casting machine can be attached to the support element. The guide rail has a first running surface and a second running surface, wherein the running surfaces are provided on opposite sides of the guide rail. The support element, to which a cooling block can be attached as mentioned, has at least three rollers, of which two rollers are in rolling contact with the first running surface of the guide rail, and at least one further roller is in rolling contact with the second running surface of the guide rail. At least one roller is preloaded towards the guide rail such that constant rolling contact, preferably of all three rollers, is thereby ensured with the running surfaces of the guide rail.

In an advantageous further embodiment of the invention, the two rollers, which are in rolling contact with the first running surface of the guide rail, are arranged spaced apart from one another, wherein the roller in rolling contact with the second running surface of the guide rail is particularly arranged in the middle between the two first-mentioned rollers, which are in rolling contact with the first running surface of the guide rail. Expediently in this case, the roller, which is in rolling contact with the second running surface and which is thus arranged on the opposite side of the guide rail as compared to the two other rollers, is preloaded towards the guide rail. As previously explained, this leads to the advantageous effect that all three of these rollers are pulled in the direction of the running surfaces of the guide rail, which ensures a constant rolling contact of these rollers with the guide rail and prevents any potential play between the guide rail and the support element guided along same.

In an advantageous enhancement of the aforementioned embodiment of the present invention, it may be provided that the two rollers, which are in rolling contact with the first running surface of the guide rail, are arranged offset laterally to one another on the support element in reference to its upper edge. This results in the advantage that the distance between the center of gravity of the support element and the rollers attached thereto is less, which likewise contributes to reducing the tendency of the support element to tip over.

According to a further embodiment, which is given separate significance, the present invention provides for a transport device, which is provided, in particular, for the transport of cooling blocks in a caterpillar casting machine, wherein said transport device comprises a guide rail, which forms an endless circulating track for a caterpillar casting machine, and a support element with a plurality of rollers, by means of which the support element is guided on the guide rail fixture and rolls along same. A cooling block can be attached to the support element. The guide rail fixture has running surfaces, which are formed in the form of a first guide rail and a second guide rail arranged opposite and parallel thereto, wherein the guide rails form between them the endless circulating track. The support element, to which a cooling block of the caterpillar casting machine can be attached, has at least three rollers, of which two rollers are in rolling contact with the running surface of the first guide rail, wherein at least one further roller is in rolling contact with the running surface of the second guide rail. At least one roller is preloaded away from a guide rail, whereby constant contact of the at least three rollers with the guide rail fixture and/or its guide rails is ensured.

In an advantageous enhancement of the last-mentioned embodiment of the invention, it may be provided that the two rollers, which are in rolling contact with the running surface of the first guide rail, are arranged spaced apart from one another, wherein the roller in rolling contact with the running surface of the second guide rail is particularly arranged in the middle between the two first-mentioned rollers, which are in rolling contact with the running surface of the first guide rail. As previously explained for the first-mentioned embodiment of the invention, such positioning of the roller, which is in rolling contact with the running surface of the second guide rail, in the middle between the two other rollers leads to the advantage of reducing the tipping moment for the support element, and thus to smooth running along the support element along the guide rail fixture. In this case, it is appropriate that the roller, which is in rolling contact with the running surface of the second side rail and thus is arranged in the middle between the two other rollers, is preloaded away from the second guide rail. All three rollers are hereby pressed against the running surfaces of the assigned guide rails of the guide rail fixture, which ensures constant rolling contact and prevents potential play between the guide rails and the support element guided along same.

The invention is based on the essential knowledge that it is assured that a tipping moment is prevented by the aforementioned at least three rollers, which are provided on a support element, for said support element in reference to its guidance and/or movement along the guide rail, wherein, thanks to the preloading, which is provided for at least one of the rollers, play is removed from this component. For the present invention, it is hereby advantageously achieved that the height difference at the edges of adjacent cooling blocks, which are attached, along the circulating track of the guide rail or the guide rail fixture, to the support elements guided along same and, in doing so, form the moving casting mold, is at least reduced or completely eliminated as compared to the aforementioned prior art in the best-case scenario. The previously known problem of edge marks, which have formed between adjacent cooling blocks of a caterpillar casting machine, can hereby be effectively counteracted. In other words, the edge marks on the surface of the casting material are thus reduced, or prevented in the best-case scenario, which means a significant improvement in the casting strip quality.

In an advantageous further embodiment of the invention, it may be provided that the aforementioned preloading of the at least one roller is formed by a spring element. This leads to the advantage that the preloading is formed by a passive element, namely by a tension spring (with the embodiment, according to which the roller, which is in rolling contact with the second running surface of the guide rail, is preloaded towards said guide rail), or in the form of a compression spring (with the embodiment, according to which the roller, which is in rolling contact with the running surface of the second guide rail of the guide rail fixture, is preloaded away from said guide rail). With such a passive element in the form of a spring, a separate energy supply to ensure the aforementioned preloading in order to ensure constant rolling contact between the rollers and the guide rail(s) is not necessary.

In an advantageous further embodiment of the invention, it may be provided that the aforementioned at least three rollers each are provided on the support element on two opposite side areas thereof—when viewed in its transport direction along the guide rail and/or the guide rail fixture. This means that, per support element, a total of at least six rollers are provided, with which the support element is in rolling contact with the running surfaces of the guide rail and/or the guide rail fixture and is guided along same. The provision of at least three rollers each on the two opposite side areas of the support element ensures stable guidance of a support element along the guide rail and a cooling block attached thereto when viewed over its width. This is particularly advantageous in the event that a width of cooling blocks and/or dies, which are attached to respective support elements, achieves a width of up to 2 m or even exceeds this value.

The transport device according to the present invention is provided for the use of a caterpillar casting machine and/or block casting machine and enables the casting of a plurality of alloys with a broad product spectrum. In this case, even a large casting strip width of, for example, more than 2 m can be realized without negatively impacting the casting quality.

Preferred embodiments of the invention are described in the following in detail by means of schematically simplified drawings.

The following is shown:

Figure 1:
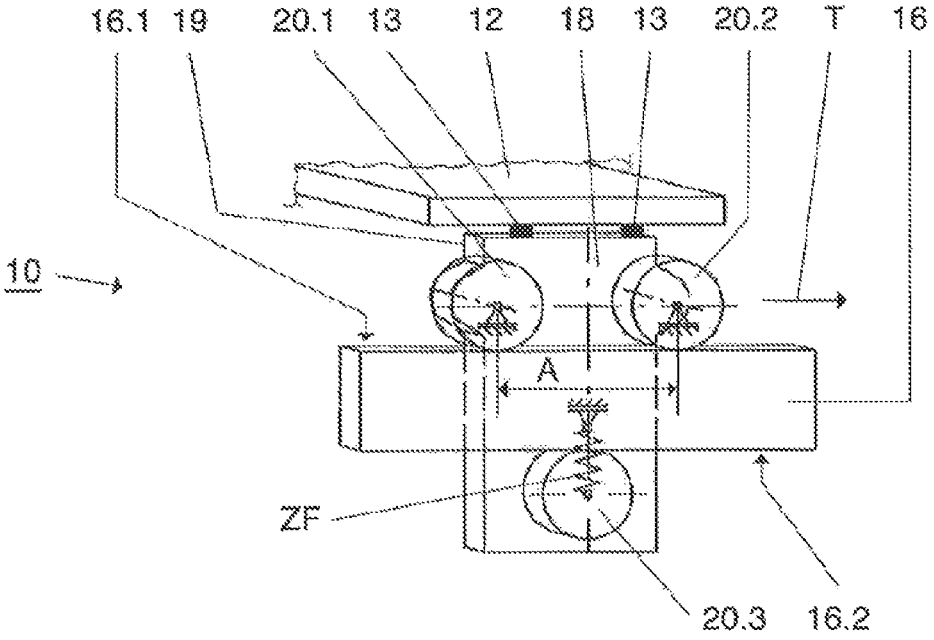
FIG. 1 is a perspective view of a support element of a transport device according to the invention in conjunction with a cooling block attached to the support element.

Preferred embodiments of a transport device 10 according to the invention, which is used particularly for the transport of cooling blocks 12 with a caterpillar casting machine 14, are explained in the following with reference to FIGS. 1 to 10. Equivalent features in the drawing are each provided with the same reference numbers. At this juncture, particular reference is made to the fact that the drawing is merely simplified and particularly not shown to scale.

A first embodiment of the transport device 10 according to the invention is shown and explained in FIGS. 1 to 4.

As shown by the side view according to FIG. 1, the transport device 10 comprises a guide rail 16, which has a first running surface 16.1 and a second running surface 16.2. Said running surfaces 16.1, 16.2 are provided on opposite sides of the guide rail 16. The transport device 10 further comprises a support element 18, to the upper edge 19 thereof a cooling block 12 of a caterpillar casting machine 14 can be attached, e.g. by means of quick fasteners 13, which are only indicated symbolically in FIG. 1.

At least three rollers, 20.1, 20.2, and 20.3, are mounted on the support element 18 so as to rotate. Two of these rollers, namely rollers 20.1 and 20.2, are in rolling contact with the first running surface 16.1 of the guide rail 16. In this case, rollers 20.1 and 20.2 are arranged spaced apart from one another by a distance A. The other roller 20.3 is attached to the support element 18 in the middle between rollers 20.1 and 20.2, namely such that said roller 20.3 is in rolling contact with the second running surface 16.2 of the guide rail 16.

Figure 5:
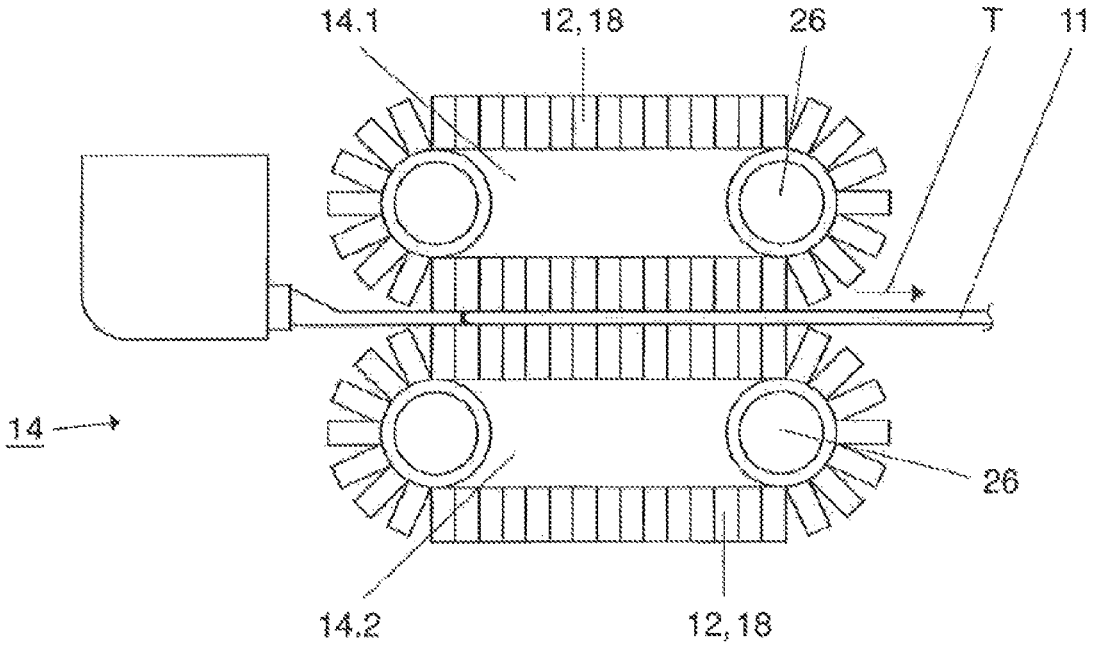
FIG. 5 is a side view of a caterpillar casting machine, with which a transport device from FIG. 1 is used.

The support element 18 is guided along the guide rail 16 by the rolling contact of rollers 20.1, 20.2, and 20.3 and is transported in a transport device T of the guide rail 16 during operation of a caterpillar casting machine 14 (cf. FIG. 5).

Roller 20.3, which, as previously explained, is in rolling contact with the second running surface 16.2 of the guide rail 16, is preloaded by a spring element, by a tension spring ZF in this case, towards the guide rail 16. Thus, roller 20.3 is pulled against the guide rail 16 by the tension spring ZF. In the same manner, rollers 20.1 and 20.2 are hereby pulled against the guide rail 16. The result is constant rolling contact of rollers 20.1-20.3 with the running surfaces 16.1, 16.2 of the guide rail 16.

Deviating from the representation according to FIG. 1, it is also possible for the spring preloading to be provided for roller 20.1 and/or for roller 20.2, or for all of the rollers 20.1-20.3.

Figure 2:
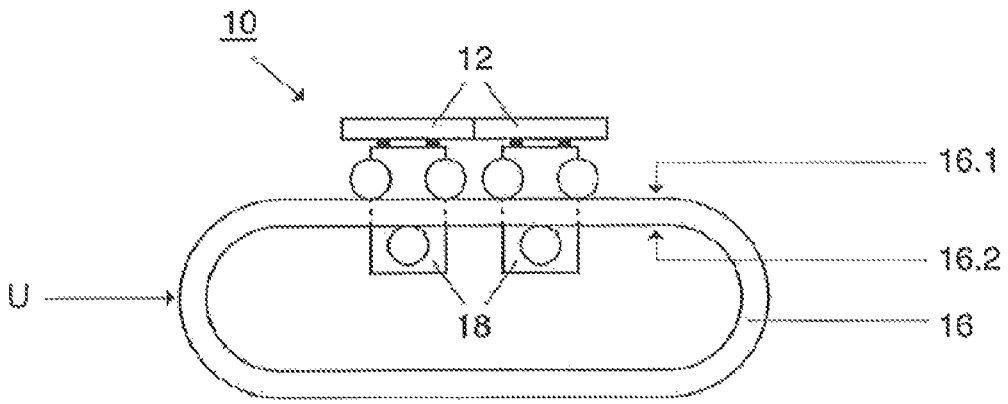
FIG. 2 is a side view of a guide rail of the transport device from FIG. 1 and an endless circulating track thereby formed.

FIG. 2 shows a side view of the guide rail 16. As is clear, an endless circulating track U is formed by this guide rail 16. A plurality of support elements 18 is guided on the guide rail 16 such that a closed surface is formed in the area of the straight sections of the circulating track U by the cooling blocks 12 adjacent one another. For the purposes of a simplified representation, only two support elements 18 with the cooling blocks 12 attached thereto are shown in FIG. 2.

Figure 3:
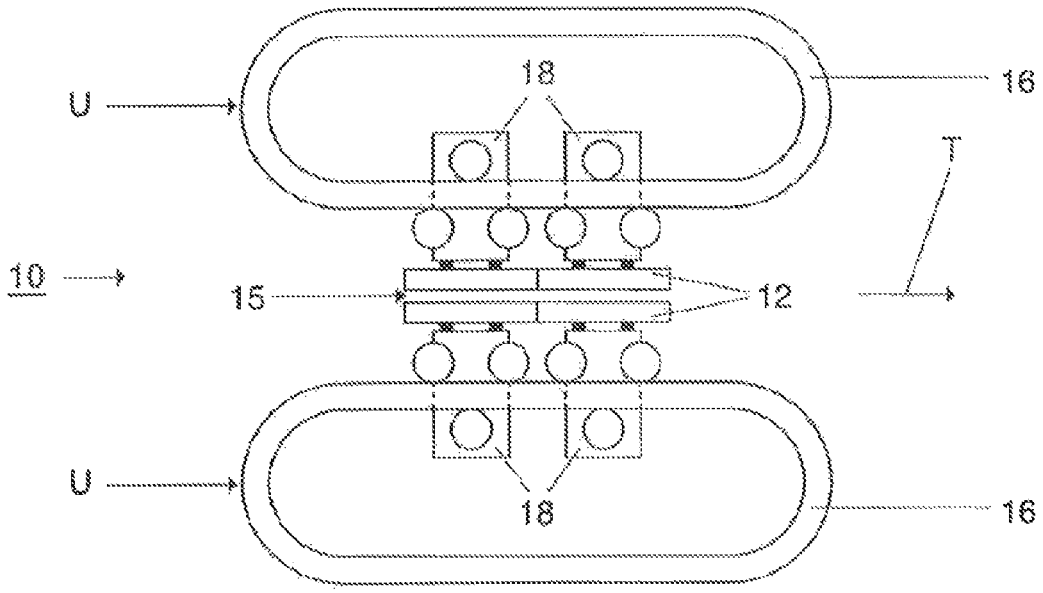
FIG. 3 is a side view of two guide rails according to FIG. 2, with which two oppositely arranged endless circulating tracks are formed for a caterpillar casting machine.

FIG. 3 shows a side view of two guide rails 16 according to FIG. 2, with which two oppositely arranged endless circulating tracks U are formed for a caterpillar casting machine 14 (cf. FIG. 5). It is understood with respect to this that a plurality of support elements 18 with cooling blocks 12 attached thereto are guided along each guide rail 16 such that a continuous chain of support elements 18 forms, which are conveyed or transported in the transport direction T along the guide rails 16. To illustrate the functional principle of the present invention, only two support elements 18, with cooling blocks 12 attached thereto, are shown on the two guide rails 16 in FIG. 3.

FIG. 3 shows that a casting mold 15 is formed between the cooling blocks 12, which reach juxtaposition in the straight sections of the circulating track U of the guide rails 16. In light of the transport device T of the support elements 18 along the guide rails 16, this casting mold 15 is a moving casting mold.

Figure 4:
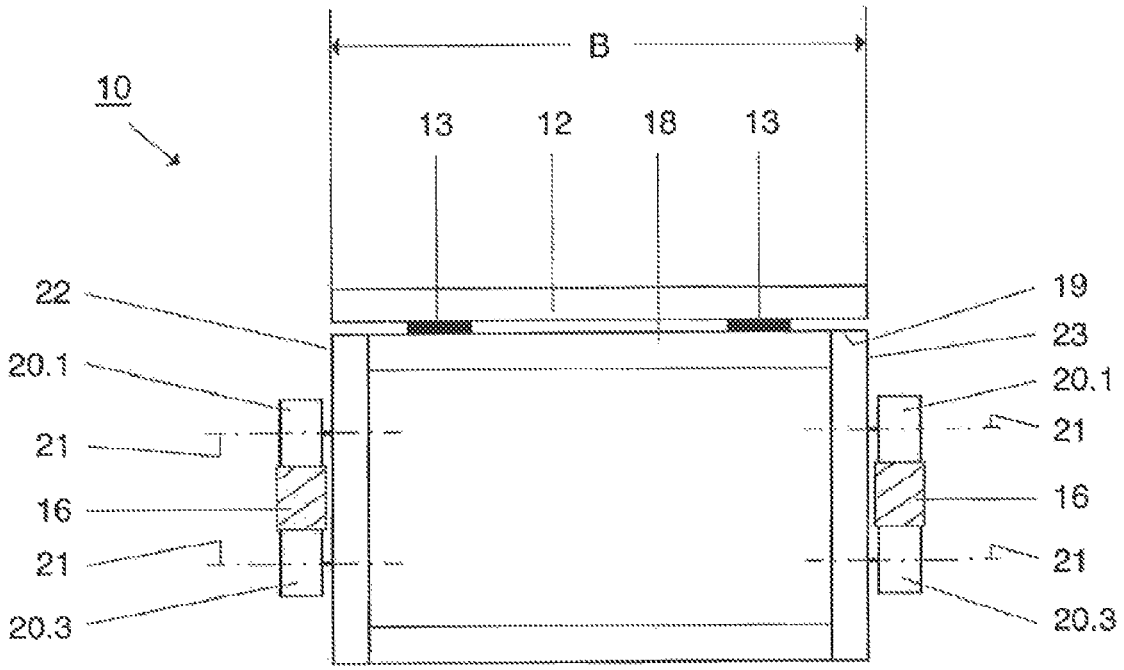
FIG. 4 is a front view of the support element from FIG. 1.

FIG. 4 shows a front view of the support element 18 from FIG. 1. It is clear from this that the three rollers, 20.1, 20.2, and 20.3, are mounted, so as to rotate, on a left-hand side area 22 and on a right-hand side area 23 of the support element 18. The axes of rotation of these rollers are indicated symbolically by the dashed lines "21."

The front view of FIG. 4 is understood to be the view from the left with reference to FIG. 1. Accordingly, only rollers 20.1 are seen in FIG. 4 above the guide rail 16, i.e. in rolling contact with their first running surface 16.1, wherein rollers 20.2 are arranged underneath and cannot be seen in FIG. 4.

FIG. 5 shows a simplified side view of a caterpillar casting machine 14, with which the transport device 10 according to the invention from FIG. 1 is used. The caterpillar casting machine 14 has an upper caterpillar 14.1 and a lower caterpillar 14.2, each of which is formed from a plurality of support elements 18 and cooling blocks 12 attached thereto, which are transported along the corresponding guide rails 16 in the transport direction T. Casting material 11 (cf. FIG. 5) is produced by casting liquid metal into the moving casting mold 15 (cf. FIG. 3).

Figure 6:
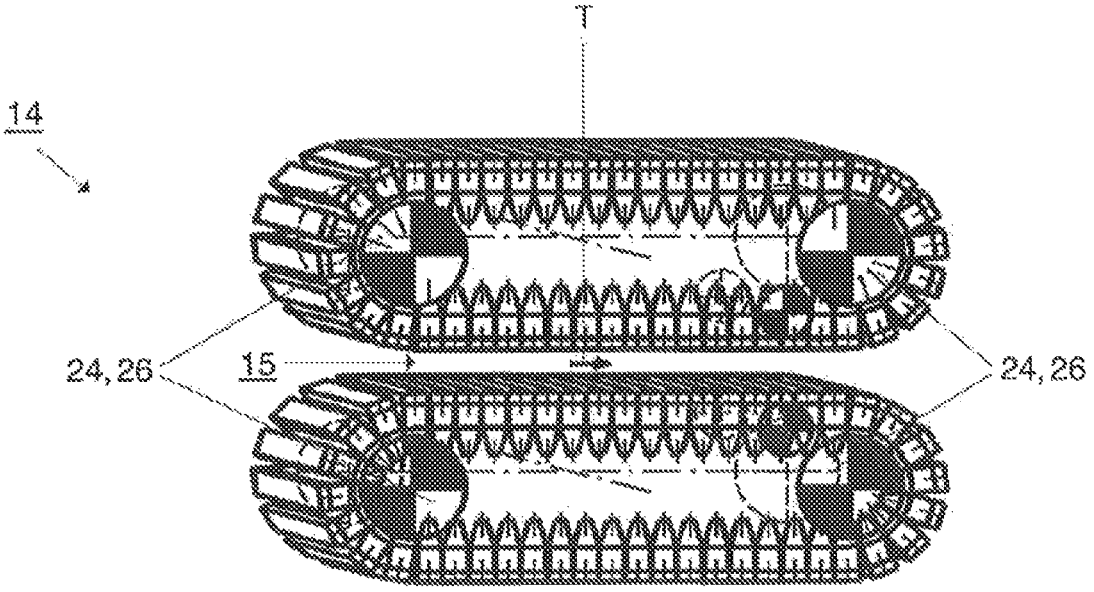
FIG. 6 is a perspective view of the caterpillar casting machine from FIG. 5.

FIG. 6 shows the caterpillar casting machine 14 again in a simplified perspective view. Here it is shown that drive devices 24 with drive wheels 26, with which a transport of the support elements 18 and the cooling blocks 12 attached thereto takes place in the transport direction T, are provided in the deflection areas of the upper and lower caterpillar 14.1, 14.2.

A second embodiment of the transport device 10 according to the invention is shown and explained in FIGS. 7 to 10.

Figure 7:
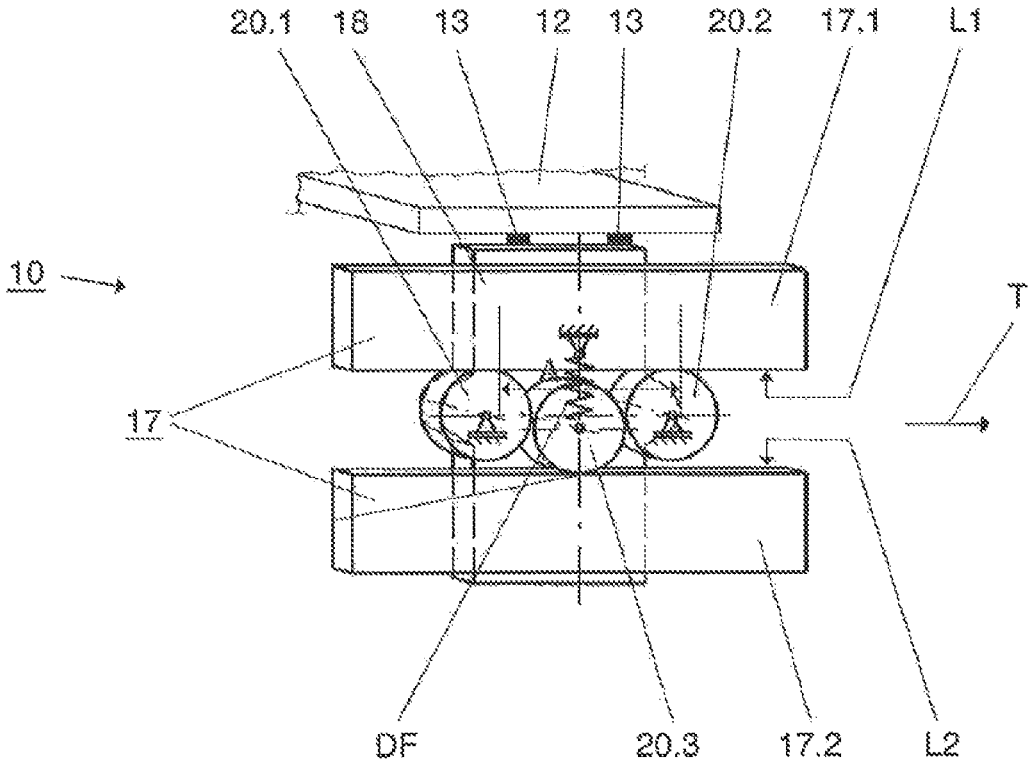
FIG. 7 is a perspective view of a support element of a transport device according to the invention according to a further embodiment.

As shown by the side view according to FIG. 7, the transport device 10 according to this embodiment comprises a guide rail fixture 17, which has a first guide rail 17.1 and a second guide rail 17.2. A total of three rollers 20.1, 20.2, and 20.3, which are each positioned between the two guide rails 17.1, 17.2, are mounted on the support element 18 of the transport device 10. Specifically, two rollers, namely rollers 20.1 and 20.2, are each in rolling contact with the running surface L1 of the first guide rail 17.2, wherein the third roller, namely roller 20.3, is in rolling contact with the running surface L2 of the second guide rail 17.2. Expediently, roller 20.3 is preloaded against the guide rail 17.2 by means of a spring element, which is by means of a compression spring DF in this case. In other words, roller 20.3 is pressed against the second guide rail 17.2 by means of the compression spring DF. In the same manner, rollers 20.1, 20.2 are hereby pressed against the running surface L1 of the first guide rail 17.1. As a result, play-free guidance of the support element 18 is hereby ensured along the guide rail fixture 17 in the transport device T.

In the same manner as with the embodiment from FIG. 1, it is possible, for the embodiment from FIG. 7, to attach a cooling block 12, e.g. by means of quick fasteners 13, to an upper edge 19 of the support element 18.

Figure 8:
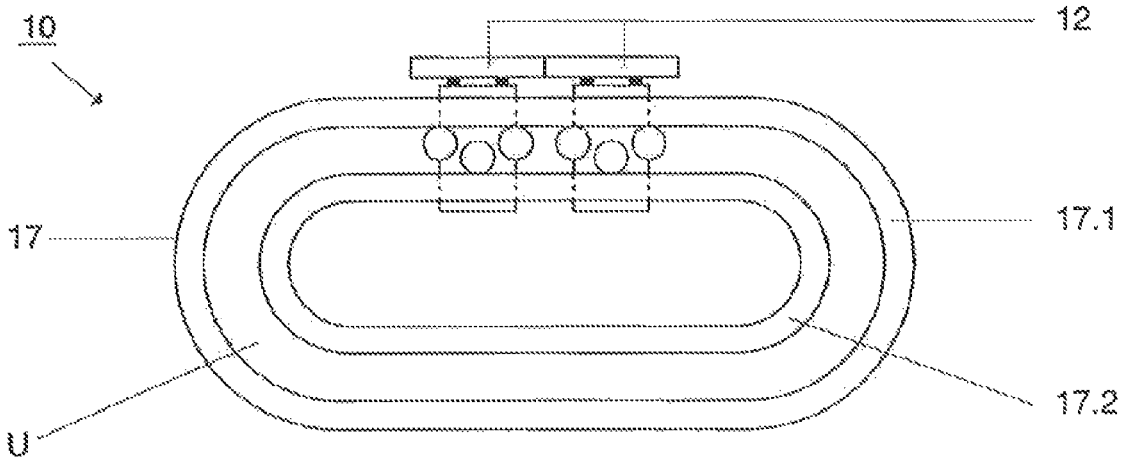
FIG. 8 is a side view of a guide rail fixture of the transport device from FIG. 7.

FIG. 8 shows a side view of a guide rail fixture 17, on which a plurality of support elements 18 and cooling blocks 12 attached thereto are guided along a circulating track U, which is formed by said guide rail fixture 17. For the purposes of a simplified representation, only two such support elements 18 with cooling blocks 12 attached thereto are shown in FIG. 8. In the same manner as previously explained regarding FIG. 2, a closed surface is formed in the straight sections of the circulating track U by means of cooling blocks 12 adjacent to one another, said circulating track being formed by the guide rail fixture 17.

Figure 9:
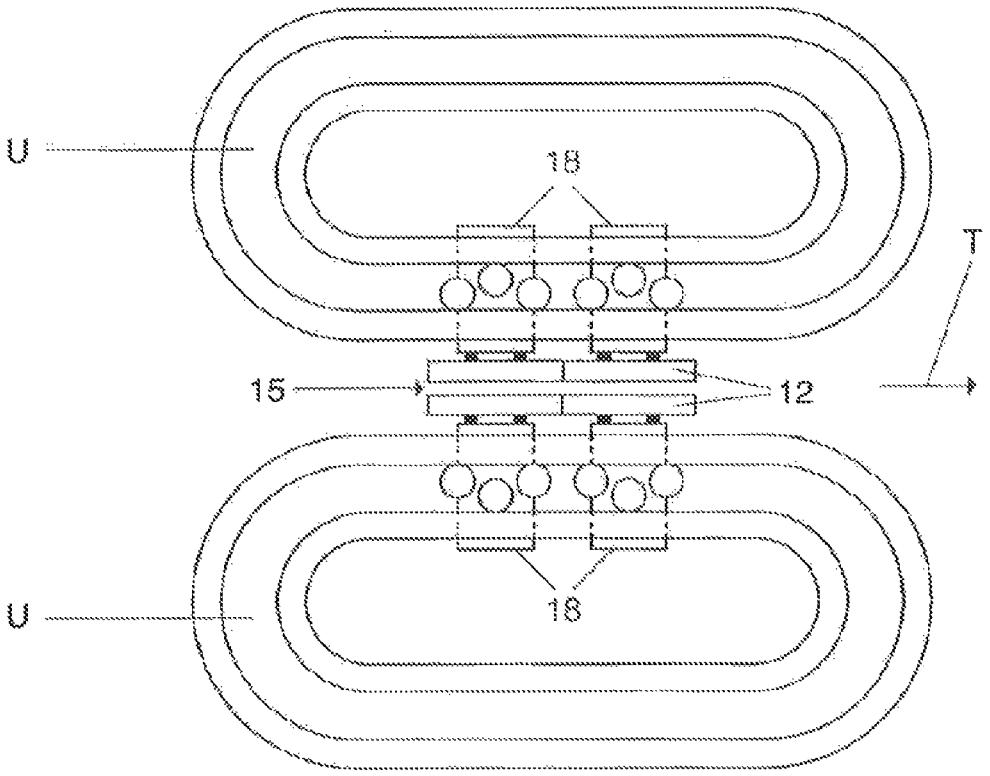
FIG. 9 is a side view of two guide rail fixtures according to FIG. 8, which may be provided jointly for a caterpillar casting machine according to FIG. 4.

FIG. 9 shows a side view of two guide rail fixtures 17 according to FIG. 8, with which two oppositely arranged endless circulating tracks U are formed for a caterpillar casting machine 14 of FIG. 5. For reasons of simplification, only two support elements 18, with cooling blocks 12 attached thereto, are shown on the two guide rail fixtures 17 in FIG. 9. In the same manner as explained with FIG. 3, a moving casting mold 15, which is used to produce a casting material 11 (cf. FIG. 5), is formed between the cooling blocks 12, which reach a juxtaposition in the straight sections of the circulating track U.

Figure 10:
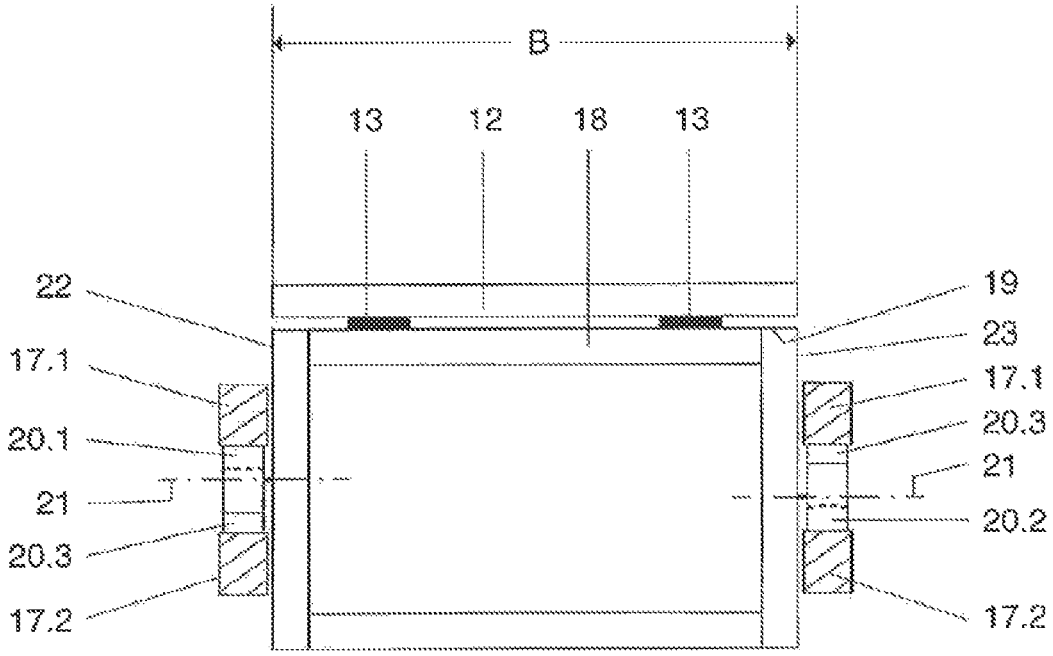
FIG. 10 is a front view of the support element from FIG. 7.
Figure 11:
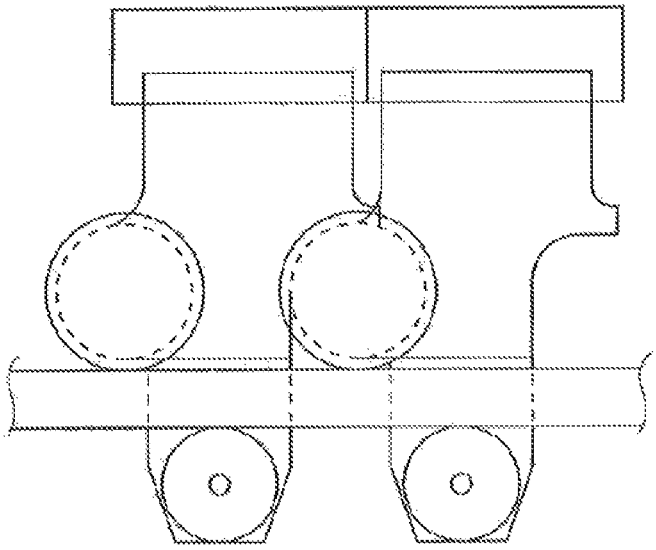
Fig. 11 (Prior art)
FIG. 11 is a side elevation view of a prior art roll support illustratively depicting adjacent support members having main rollers positioned on a track.
Figure 12:
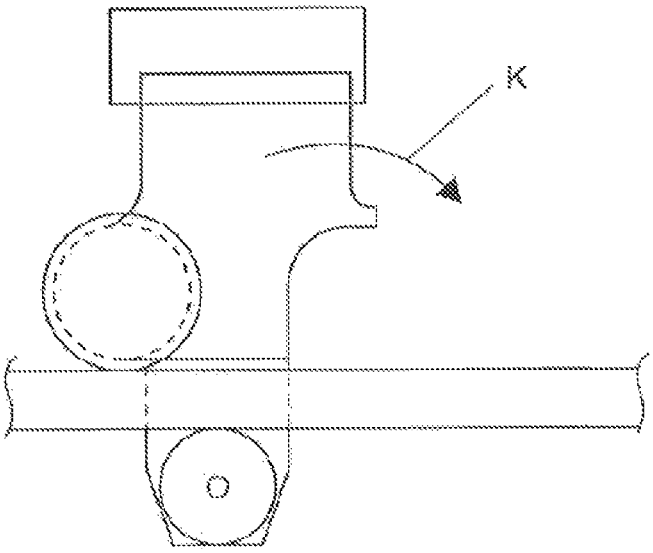
Fig. 12 (Prior art)
FIG. 12 is a partial view of the prior art roll support of FIG. 11 depicting a single support member illustratively prone to tipping over.

FIG. 10 shows the support element of FIG. 7 in a front view. It is clear from this that the three rollers, 20.1, 20.2, and 20.3, are mounted in a rotatable manner in both the left-hand side area 22 and in the right-hand side area 23 of the support element 18. The axes of rotation of the rollers are indicated symbolically by dashed lines "21," namely in the left-hand side area 22 of the support element 18 for roller 20.1 and in the right-hand side area 23 of the support element 18 for roller 20.2.

The left-hand side area 22, as shown in FIG. 10, corresponds to a view from the left with reference to FIG. 7. In this case, roller 20.1, which is in rolling contact with the running surface L1 of the first guide rail 17.1, is shown in the image foreground. A part of roller 20.3, which is in rolling contact with the running surface L2 of the second guide rail 20.3, is positioned behind (i.e. underneath roller 201.)

The representation of the rollers on the right-hand side area 23 of FIG. 10 corresponds to a view of the middle roller 20.2 from the left. In this regard, the representation of FIG. 10 shows roller 20.2 in the image foreground in the right-hand side area 23 of the support element 18. A part of roller 20.3, which is in rolling contact with the running surface L1 of the first guide rail 17.1, is positioned behind (and above roller 20.2 in the image plane from FIG. 10).

Deviating from the representations in FIGS. 7 and 10, it may also be provided for this embodiment of the transport device 10 that the middle roller 20.2 is in rolling contact with the running surface L1 of the first guide rail 17.1, wherein the two other rollers, 20.1 and 20.3, are both in rolling contact with the running surface L2 of the second guide rail 17.2. Furthermore, it is also possible for the spring preloading to be provided for roller 20.1 and/or for roller 20.3, or for all of the rollers 20.1-20.3.

The two embodiments of the transport device 10 according to FIGS. 1 and 7 have in common that the cooling blocks 12, which can be attached to the respective support element 18, extend, in one piece, over the entire width B of the mold gap 15 of the caterpillar casting machine of FIG. 5. Accordingly, the support elements 18 are adapted such that a cooling block with such a width B (cf. FIG. 4, FIG. 10) can be attached thereto, e.g. by means of the quick fasteners 13 or similar means suitable for this.

For both of the previously explained embodiments of the transport device 10, it is significant that the guidance of the support element 18 along the guide rail 16 and/or the guide rail fixture 17 is implemented by means of a total of at least six rollers due to the provision of the rollers 20.1, 20.2, and 20.3 on both the left-hand side area 22 and the right-hand side area 23 of the support element 18. Particularly in the event that a cooling block 12 should have a large width B (cf. FIG. 4, FIG. 7), the attachment of the rollers 20.1, 20.2 to the side areas 22, 23 of the support element 18 has a positive effect on the smooth running behavior along the guide rail(s). The previously explained preloading, to which at least roller 20.3 is subject and thereby pulled in the direction of the guide rail 16 (cf. FIG. 1) and/or pressed against the second guide rail 17.2 (cf. FIG. 7), also contributes to this.

A cooling device, by means of which the cooling blocks 12 are intensively cooled during operation of the caterpillar casting machine 14, is not shown in the drawing.

LIST OF REFERENCE NUMBERS

10 Transport device
11 Casting material
12 Cooling block
13 Quick fastener(s)
14 Caterpillar casting machine
14.1 Upper caterpillar
14.2 Lower caterpillar
15 Casting mold
16 Guide rail
16.1 First running surface (of the guide rail 16)
16.2 Second running surface (of the guide rail 16)
17 Guide rail fixture
17.1 First guide rail (of the guide rail fixture 17)
17.2 Second guide rail (of the guide rail fixture 17)
18 Support element
19 Upper edge (of the support element 18)
20.1.-20.3 Roller(s)
21 Axes (of rollers 20.1, 20.2, and 20.3)
22, 23 Side areas (of the support element 18)
24 Drive device
26 Drive wheel (of a drive device 24)
A Distance between rollers 20.1 and 20.2
B Width (of a cooling block 12)
DF Compression spring
L Running surfaces (of the guide rail fixture 17)
L1 Running surface (of the first guide rail 17.1)
L2 Running surface (of the second guide rail 17.2)
T Transport device (of a support element 18 along the guide rail 16 and/or the guide rail fixture 17)
U Circulating track (of the guide rail 16 and/or the guide rail fixture 17)
ZF Tension spring

The invention claimed is:

1. A transport device (10) for transporting cooling blocks (12) in a caterpillar casting machine (14), wherein the transport device (10) comprises:

a guide rail (16), which forms an endless circulating track (U) for a caterpillar casting machine (14) and a support element (18) with a plurality of rollers (20), by means of which the support element (18) is guided on the guide rail (16) and rolls along same, wherein a cooling block (12) of a caterpillar casting machine (14) can be attached to the support element (18), characterized in that the guide rail (16) has a first running surface (16.1) and a second running surface (16.2), wherein the running surfaces (16.1, 16.2) are provided at opposite sides of the guide rail (16) with respect to one another, and that the support element (18) has at least three rollers (20.1, 20.1, 20.3), of which two rollers (20.1, 20.2) are in rolling contact with the first running surface (16.1) of the guide rail (16), and at least one further roller (20.3) is in rolling contact with the second running surface (16.2) of the guide rail (16), wherein at least one roller (20.1; 20.2; 20.3) is preloaded towards the guide rail (16).

2. The transport device (10) according to claim 1, characterized in that the two rollers (20.1, 20.2) in rolling contact with the first running surface (16.1) of the guide rail (16) are arranged at a distance (A) apart from one another, wherein the roller (20.3) in rolling contact with the second running surface (16.2) of the guide rail (16) is particularly arranged in the middle between the two rollers (20.1, 20.2), which are in rolling contact with the first running surface (16.1) of the guide rail (16).

3. The transport device (10) according to claim 1, characterized in that the roller (20.3) in rolling contact with the second running surface (16.2) of the guide rail (16) is preloaded towards the guide rail (16).

4. The transport device (10) according to claim 1, characterized in that the two rollers (20.1, 20.2), which are in rolling contact with the first running surface (16.1) of the guide rail (16), are arranged on the support element (18) laterally offset to one another in reference to its upper edge (19).

5. A transport device (10) for transportingcooling blocks (12) in a caterpillar casting machine (14), wherein the transport device (10) comprises:

a guide rail fixture (17), which forms an endless circulating track (U), and a support element (18) with a plurality of rollers (20), by means of which the support element (18) is guided on the guide rail fixture (17) and rolls along same, wherein a cooling block (12) can be attached to the support element (18), characterized in that the guide rail fixture (17) has running surfaces (L), which are formed in the form of a first guide rail (17.1) and a second guide rail (17.2) arranged opposite and parallel thereto, wherein the guide rails (17.1, 17.2) form between them the endless circulating track (U), and that the support element (18) has at least three rollers (20.1; 20.2; 20.3), of which two rollers (20.1, 20.2) are in rolling contact with the running surface (L1) of the first guide rail (17.1), wherein at least one further roller (20.3) is in rolling contact with the running surface (L2) of the second guide rail (17.2), wherein at least one roller (20.1, 20.2, 20.3) is preloaded towards a guide rail (17.1, 17.2).

6. The transport device (10) according to claim 5, characterized in that the two rollers (20.1, 20.2) in rolling contact with the running surface (L1) of the first guide rail (17.1) are arranged at a distance (A) apart from one another, wherein the roller (20.3) in rolling contact with the running surface (L2) of the second guide rail (17.2) is particularly arranged in the middle between the two rollers (20.1, 20.2), which are in rolling contact with the running surface (L1) of the first guide rail (17.1).

7. The transport device (10) according to claim 6, characterized in that the roller (20.3) in rolling contact with the running surface (L2) of the second guide rail (17.2) is preloaded away from the second guide rail (17.2).

8. The transport device (10) according to claim 5, characterized in that the preloading of the at least one roller (20.1; 20.2; 20.3) is formed by a spring element (DF; ZF).

9. The transport device (10) according to claim 5, characterized in that the at least three rollers (20.1, 20.2, 20.3) are provided on the support element (18) on two opposite side areas (22, 23) thereof—when viewed in its transport direction (T) along the guide rail (16) and/or the guide rail fixture (17)—wherein said at least three rollers (20.1, 20.2, 20.3) are in rolling contact with running surfaces (16.1, 16.2) of the guide rail (16) and/or running surfaces (L) of the guide rail fixture (17).

10. The transport device (10) according to claim 5, characterized in that a plurality of support elements (18), which can be moved in a circulating manner like a caterpillar around the guide rail(s) (16; 17.1, 17.2) by means of a drive device (24), are provided along the guide rail (16) and/or guide rail fixture (17).

* * * * *